US006089400A

United States Patent [19]

Park

[11] Patent Number: 6,089,400

[45] Date of Patent: Jul. 18, 2000

[54] TOLL-TICKET ISSUING APPARATUS FOR CONTINUOUS ISSUING OF TICKET

[75] Inventor: Yong-Sung Park, Kyoungki-do, Rep. of Korea

[73] Assignee: Samsung Electronics Co., Ltd., Suwon, Rep. of Korea

[21] Appl. No.: 09/138,516

[22] Filed: Aug. 24, 1998

[30] Foreign Application Priority Data

Aug. 22, 1997 [KR] Rep. of Korea ..... 97-40266

[51] Int. Cl.[7] ..... G07F 11/00

[52] U.S. Cl. ..... 221/14; 221/17

[58] Field of Search ..... 221/2, 7, 9, 11, 221/14, 17, 92, 103, 104

[56] References Cited

U.S. PATENT DOCUMENTS 4,037,702 7/1977 Albert ..... 221/17

FOREIGN PATENT DOCUMENTS 3-25591 2/1991 Japan ..... 221/14

*Primary Examiner*—Kenneth W. Noland

*Attorney, Agent, or Firm*—Robert E. Bushnell, Esq.

[57] ABSTRACT

An automatic toll-ticket issuing apparatus enables toll-tickets to be continuously issued. Plural ticket containers are provided in a housing, and the ticket issuing route between a current ticket container and a ticket issuance slot is changed to an alternative ticket issuing route between an alternative ticket container and the ticket issuance slot when the current ticket container tuns out of ticket, and thus termination of ticket issuance is avoided and tickets are issued continuously. Further, new tickets are resupplied into a nearly empty ticket container without termination of the ticket issuing operation.

20 Claims, 5 Drawing Sheets

TOLL-TICKET ISSUING APPARATUS FOR CONTINUOUS ISSUING OF TICKET

CLAIM OF PRIORITY

This application makes reference to, incorporates the same herein, and claims all benefits accruing under 35 U.S.C. §119 from an application for TOLL-TICKET ISSUING APPARATUS FOR CONTINUOUS ISSUING OF TICKET earlier filed in the Korean Industrial Property Office on Aug. 22, 1997 and there duly assigned Serial No. 40266/1997.

BACKGROUND OF THE INVENTION

1. Technical Field

The present invention relates to a toll-ticket issuing apparatus. More particularly, the present invention relates to an automatic toll-ticket issuing apparatus which is installed at an entrance gate of a toll-road or expressway, and which continues to issue toll-tickets to vehicles entering the road or expressway without discontinuing the ticket issuing operation.

2. Related Art

Typically, in a toll-road or expressway where a toll gate is installed at an entrance or at an outlet of the expressway, an automatic toll-ticket issuing apparatus is installed at the toll gate, and issues a toll-ticket to vehicles entering the expressway in order to collect a toll from every vehicle passing through the expressway.

A problem arises in such automatic toll-ticket apparatus in that such apparatus are typically provided with only a single cassette for stacking or storing the toll-tickets. When the stack of tickets runs out, the corresponding entrance lane of the toll gate is blocked until the empty ticket cassette is unloaded from the ticket container and is refilled with new tickets. Even if a spare cassette fully filled with new tickets is held and reserved, and then substituted for the empty cassette, there is a delay in resuming continuous discharge of the tickets.

Therefore, three is a need for the development of an automatic toll-ticket issuing apparatus which enables toll-tickets to be continuously issued, even when an initial stack of tickets runs out.

SUMMARY OF THE INVENTION

Therefore, it is an object of the present invention to provide an automatic toll-ticket issuing apparatus for solving the above problems.

It is another object of the present invention to provide an automatic toll-ticket issuing apparatus which enables a toll-ticket to be continuously issued, in which apparatus plural ticket containers are provided in a housing, and the ticket issuing route in the apparatus is changed when a container runs out of tickets so as to accommodate tickets from full ticket container, whereby termination of ticket issuance is avoided and tickets are issued continuously.

It is a further object of the present invention to provide an automatic toll-ticket issuing apparatus which enables toll-tickets to be continuously issued, wherein new tickets are supplied to a nearly empty ticket container without termination of the ticket issuing operation.

In order to achieve the above objects of the present invention, an automatic toll-ticket issuing apparatus which enables toll-tickets to be continuously issued comprises plural toll-ticket containers, plural ticket cassettes loaded in the respective toll-ticket containers and storing the stacked toll-tickets therein, ticket drawing means installed in close proximity to a predetermined area of each toll-ticket container for drawing out tickets stored in the ticket cassette, sensing means installed in close proximity to a predetermined area of each toll-ticket container for sensing when the stock of tickets stored in the ticket cassette has run out, and control means responsive to a sensing signal from the sensing means when a ticket cassette has run out of tickets for changing a ticket feed route for discharging tickets through the corresponding ticket issuing slot, thereby preventing the issuance of toll-tickets from stopping.

Furthermore, the toll-ticket containers comprise a main ticket container and auxiliary ticket containers. Moreover, the main ticket container and the auxiliary ticket container are horizontally arranged one above the other.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

The present invention will be better clarified by describing a preferred embodiment thereof with reference to the above accompanying drawings.

Figure 1:
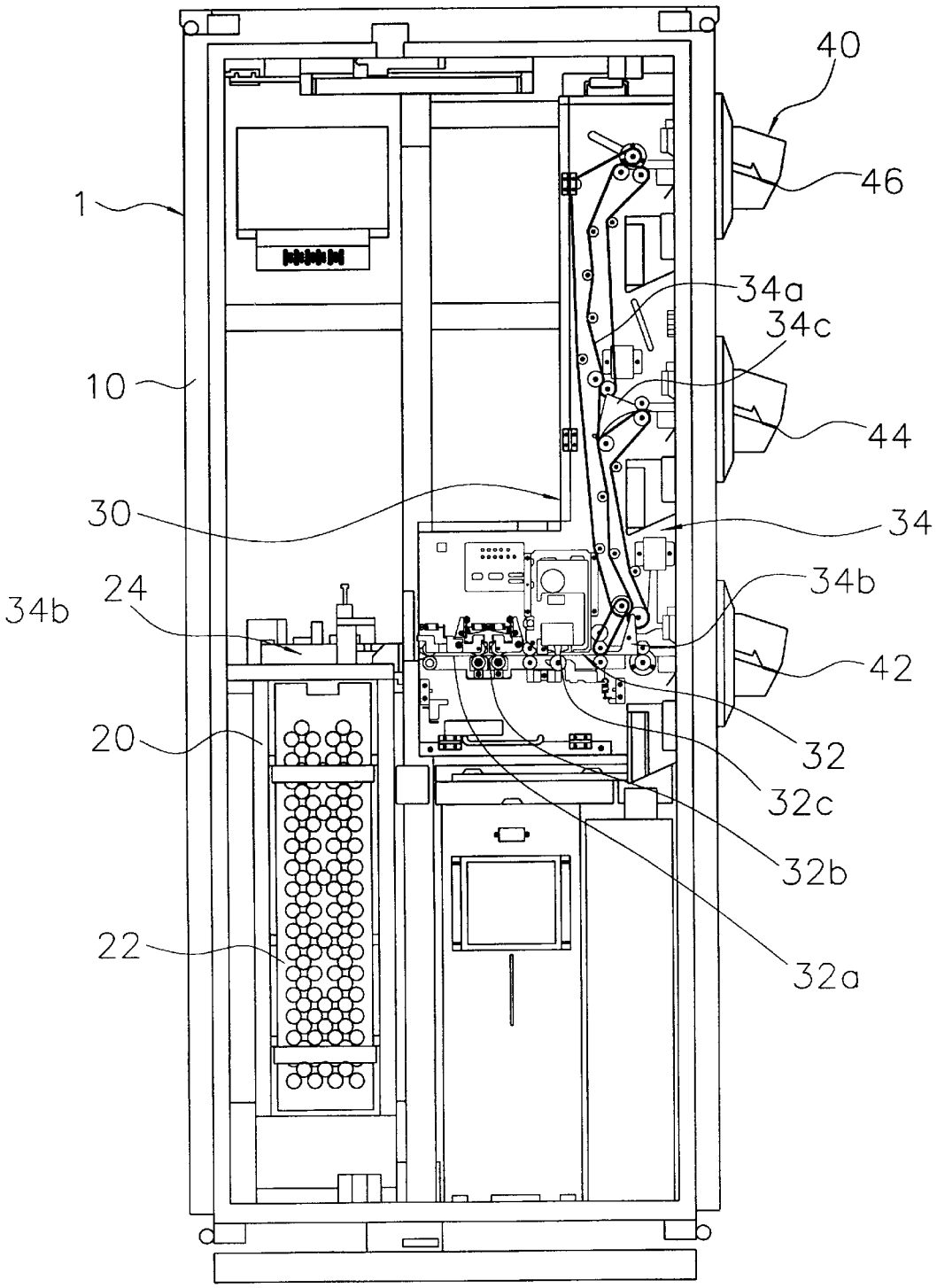
FIG. 1 is a vertical side cross sectional view of an automatic toll-ticket issuing apparatus.
Figure 2:
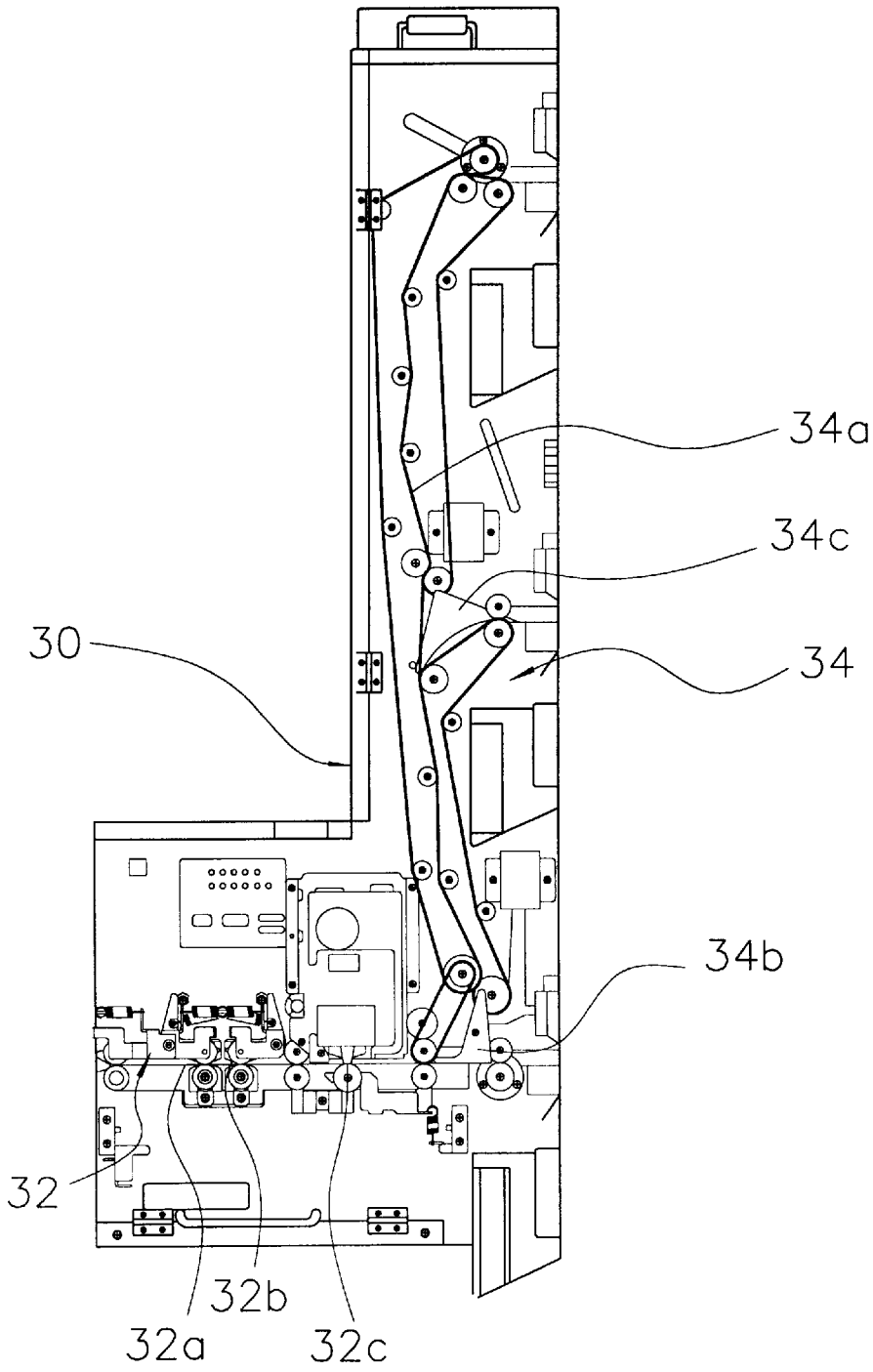
FIG. 2 is an enlarged cross sectional view of FIG. 1 showing a toll-ticket conveying member.

As shown in FIGS. 1 and 2, an automatic toll-ticket issuing apparatus 1 comprises mainly a housing 10 for accommodating various components, a stacked ticket container 20 installed vertically in a predetermined lower portion of the housing 10, a ticket conveying unit 30 for drawing a ticket (not shown) from the ticket container 20, and a ticket issuing unit 40 for issuing the ticket.

The ticket container 20 comprises a cassette 22 and a ticket lifter (not shown). The cassette 22 accommodates the stacked tickets, and is vertically loaded in the ticket container 20. The ticket lifter is provided at the lower portion of the ticket container 20, and pushes up the stacked tickets in order to prevent the level of the tickets from being reduced as tickets are issued.

The ticket conveying unit 30 comprises a linear feeding member 32 and a ticket distributor 34. The linear feeding member 32 comprises a horizontal feed lane 32*a* provided to feed the ticket horizontally, a magnet process unit 32*b* which is provided to magnetically write the information identifying the expressway entrance on the ticket, and a printing unit 32*c* for printing characters on the ticket. The ticket distributor 34 comprises a vertical feed lane 34*a* provided to feed the ticket vertically, and an upper route switch 34*b* and lower route switch 34*c* for changing the feeding direction of the ticket which is run on the vertical feed lane 34*a*.

With the automatic toll-ticket issuing unit 1 installed as described above, the ticket is drawn from the cassette 22 of the ticket container 20 and remains in a standby position. According to information as to the type of vehicle which approaches the entrance to the expressway, the ticket is fed horizontally by the running of the horizontal feed lane 32*a*. The information identifying the expressway entrance is magnetically written on a ticket by the magnet process unit 32*b*. On a predetermined area of the magnetic ticket passing through the magnet process unit 32*b*, information containing vehicle type, name of the toll gate, date, time, code of the worker, and serial number of the ticket being issued is printed by the printing unit 32*c*. If a small-sized vehicle approaches the entrance, the printed toll-ticket is horizontally fed and issued through the lower ticket issuing slot 42. If a medium or a large-sized vehicle approaches the toll gate, the printed toll-ticket is fed to the ticket distributor 34, the feeding route of the toll-ticket is changed by the lower route switch 34*b*, and the ticket is fed along the vertical feed lane 34*a*. If the feeding route of the ticket is changed by the upper route switch 34*c* during vertical feed of the ticket, a ticket corresponding to the medium-sized vehicle is issued through the middle ticket issuing slot 44. If the feeding route of the ticket is otherwise unchanged by the upper route switch 34*c* during the vertical feed of the ticket, a ticket corresponding to the large-sized vehicle further is fed along the vertical feed lane 34*a* and issued through the upper ticket issuing slot 46.

As described above, the automatic toll-ticket apparatus undertakes a series of processes; i.e., the ticket is fed by the sensing of the vehicle type, the necessary information for the issued toll-ticket is produced and printed on the ticket, and the produced ticket is issued. Since only a single cassette for stacking the toll-tickets is installed in the housing 10, the stock of the single cassette runs out after tickets are continuously discharged to the constantly approaching vehicles. The corresponding entrance lane of the toll gate is blocked when the stock of tickets runs out. The empty ticket cassette is unloaded from the ticket container for refilling with new tickets. Otherwise, the spare cassette which is fully filled with new tickets is substituted for the empty cassette and loaded into the ticket container, and issuing of tickets resumes.

In review, if the stock of tickets of the single ticket container runs out during the issuance of tickets, the issuance of ticket is stopped. Therefore, the problem of blocking the entrance lane of the toll gate can occur.

As another problem, vehicles which are lined up on the blocked lane must stop until the empty ticket cassette is refilled with new tickets or is replaced by a the spare cassette filled with new tickets, and the drivers are therefore displeased by the backup of vehicles.

Figure 3:
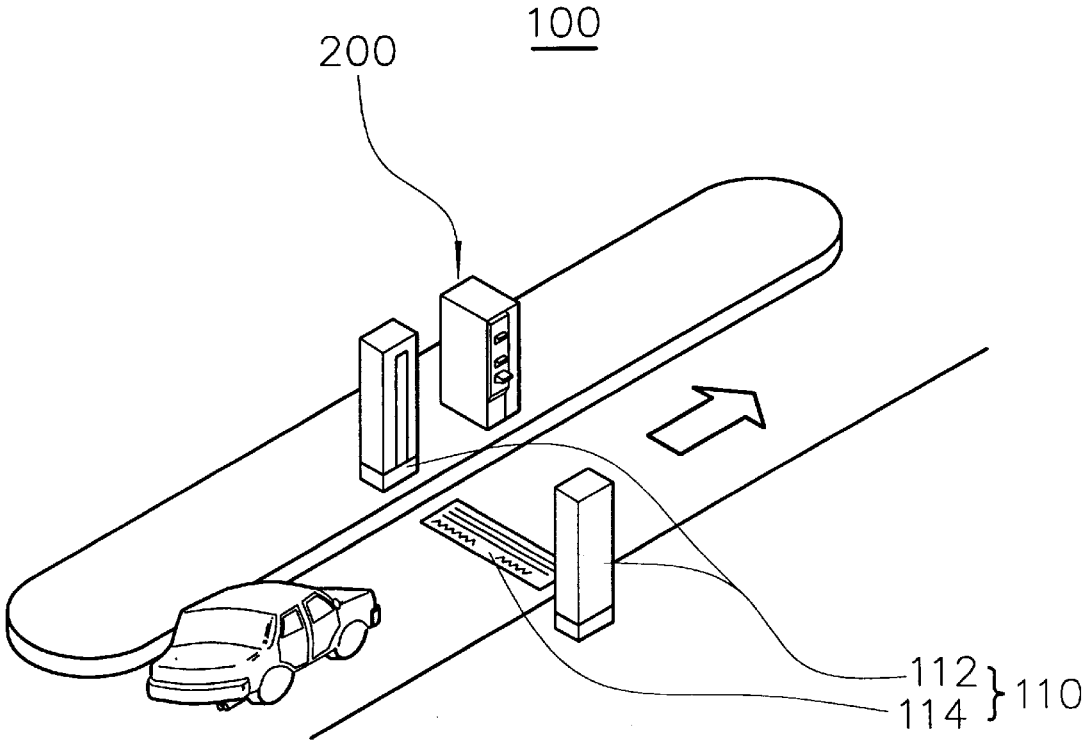
FIG. 3 is a schematic illustration showing a toll gate entrance of a highway in accordance with the present invention.

As shown in FIG. 3, an automatic toll-ticket issuing system 100 which is installed at an entrance gate of a toll-road mainly comprises a vehicle type identification unit 110 for identifying the type of vehicle approaching the toll gate, and an automatic toll-ticket issuing apparatus 200 for issuing a toll-ticket by sensing the vehicle type. The vehicle type identification unit 110 further comprises a vehicle type identification sensor 112 for identifying a vehicle, a tread sensor 114 for identifying a tread to determine a distance between wheels on the same axle, and a vehicle height sensor (not shown) for sensing a height of a vehicle.

In the automatic toll-ticket issuing system 100 of the construction described above, the vehicle type identification unit 112 identifies the type of vehicle approaching a toll gate, and the automatic toll-ticket issuing apparatus 200 issues a ticket corresponding to the type of vehicle.

Figure 4:
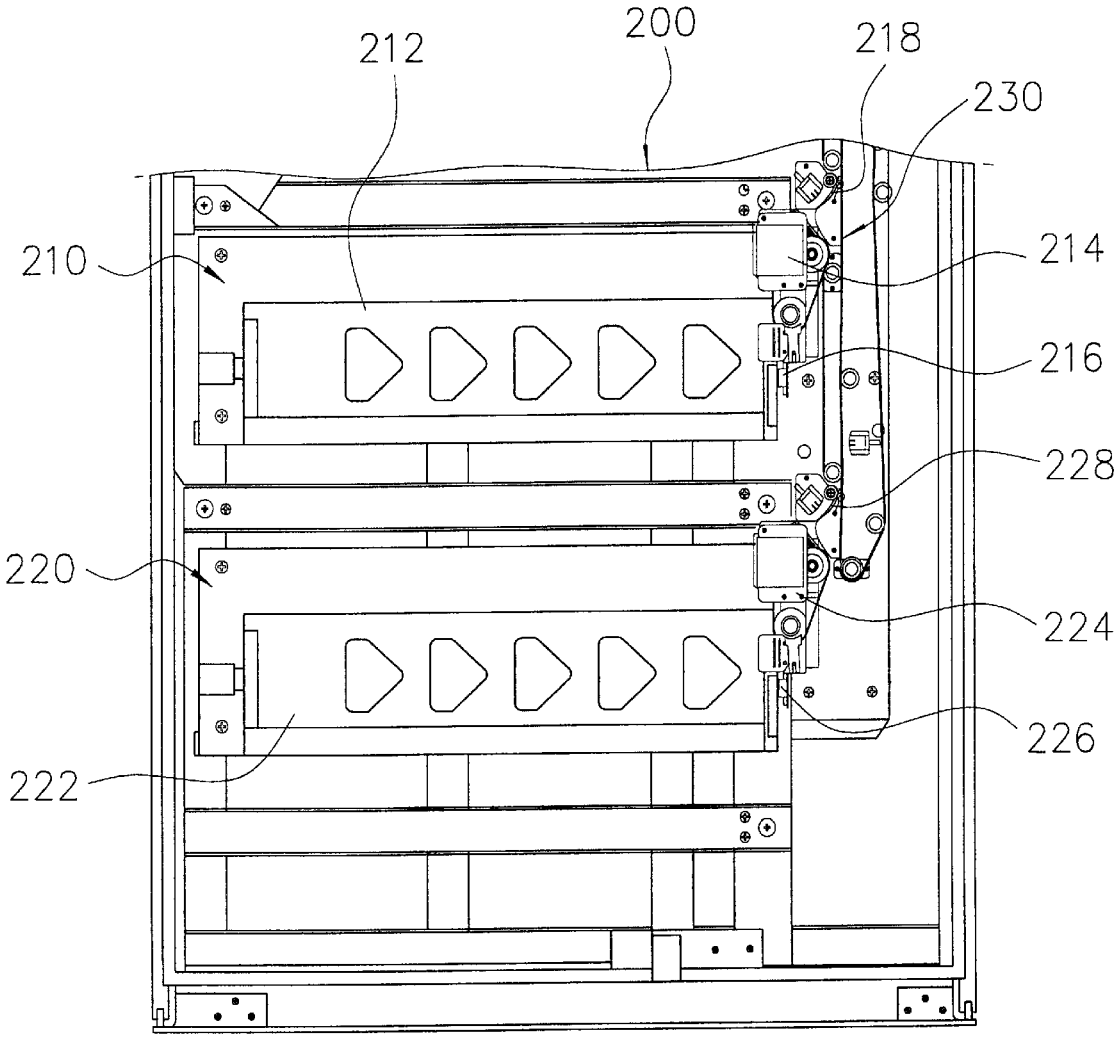
FIG. 4 is an enlarged cross sectional view of an automatic toll-ticket issuing apparatus having plural toll-ticket stackers in accordance with the present invention.

In FIG. 4, the automatic toll-ticket issuing apparatus 200 is installed at an entrance gate of a toll-road in which a toll gate is mounted at each entrance and exit. The automatic toll-ticket issuing apparatus 200 issues tickets continuously to vehicles passing through the entrance gate. The automatic toll-ticket issuing apparatus 200 comprises a toll-ticket containing section provided with a main ticket container 210 and an auxiliary ticket container 220. A main ticket cassette 212 and an auxiliary ticket cassette 222 are loaded in toll-ticket containers 210 and 220, respectively, for storing the stacked toll-tickets. Main and auxiliary ticket drawing-out units 214 and 224 are installed in close proximity to a predetermined area of each of the toll-ticket containers 210 and 220, respectively, for drawing out the tickets stored in the toll-ticket containing section, and main and auxiliary ticket run-out sensors 216 and 226 are installed in close proximity to a predetermined area of toll-ticket containers 210 and 220, respectively, for identifying the "run out" condition of the stock of tickets stored in the toll-ticket containing section. When stock of the toll-tickets stored in the main ticket cassette 212 has run out, a ticket feed route is changed by the sensing signal of the main ticket run-out sensor 216 associated with the main ticket cassette 212 so as to draw tickets from the auxiliary ticket cassette 222. Similarly, when the stock of the toll-tickets stored in the auxiliary ticket cassette 222 has run out, a ticket feed route is changed by the sensing signal of the auxiliary ticket run-out sensor 226 associated with the auxiliary ticket cassette 222 to draw tickets from the main ticket cassette 212. Therefore, issuance of tickets does not stop and is continuous.

The toll-ticket containing section may comprise two containers (i.e., a main ticket container 210 and an auxiliary ticket container 220) or more than two. However, if the number of toll-ticket containing sections is large, the construction of the apparatus is complicated, and the volume increases in proportion to the number of toll-ticket containing sections. Thus, two containers are preferable for the present invention.

The toll-ticket containing section, comprising a main ticket container 210 and an auxiliary ticket container 220, is disposed in a horizontal arrangement the automatic toll-ticket issuing apparatus 200. The main and auxiliary ticket containers 210 and 220, respectively, are loaded into the main and auxiliary ticket cassettes 212 and 222, respectively. Since main and auxiliary ticket containers 210 and 220, respectively, are horizontally arranged in one above the other, and main and auxiliary ticket cassettes 212 and 222, respectively, are horizontally loaded one above the other.

The main and auxiliary ticket cassettes 212 and 222, respectively, loaded in main and auxiliary ticket containers 210 and 220, respectively, may number the same as that of the main and auxiliary ticket containers 210 and 220, respectively. Otherwise, the main and auxiliary ticket cassettes 212 and 222, respectively, may outnumber main and auxiliary ticket containers 210 and 220, respectively. In the outnumbered condition, the still unloaded remainder of the ticket cassettes 212, 222 can be utilized as spares so that an empty cassette can be conveniently replaced with a spare cassette filled with new tickets.

Figure 5:
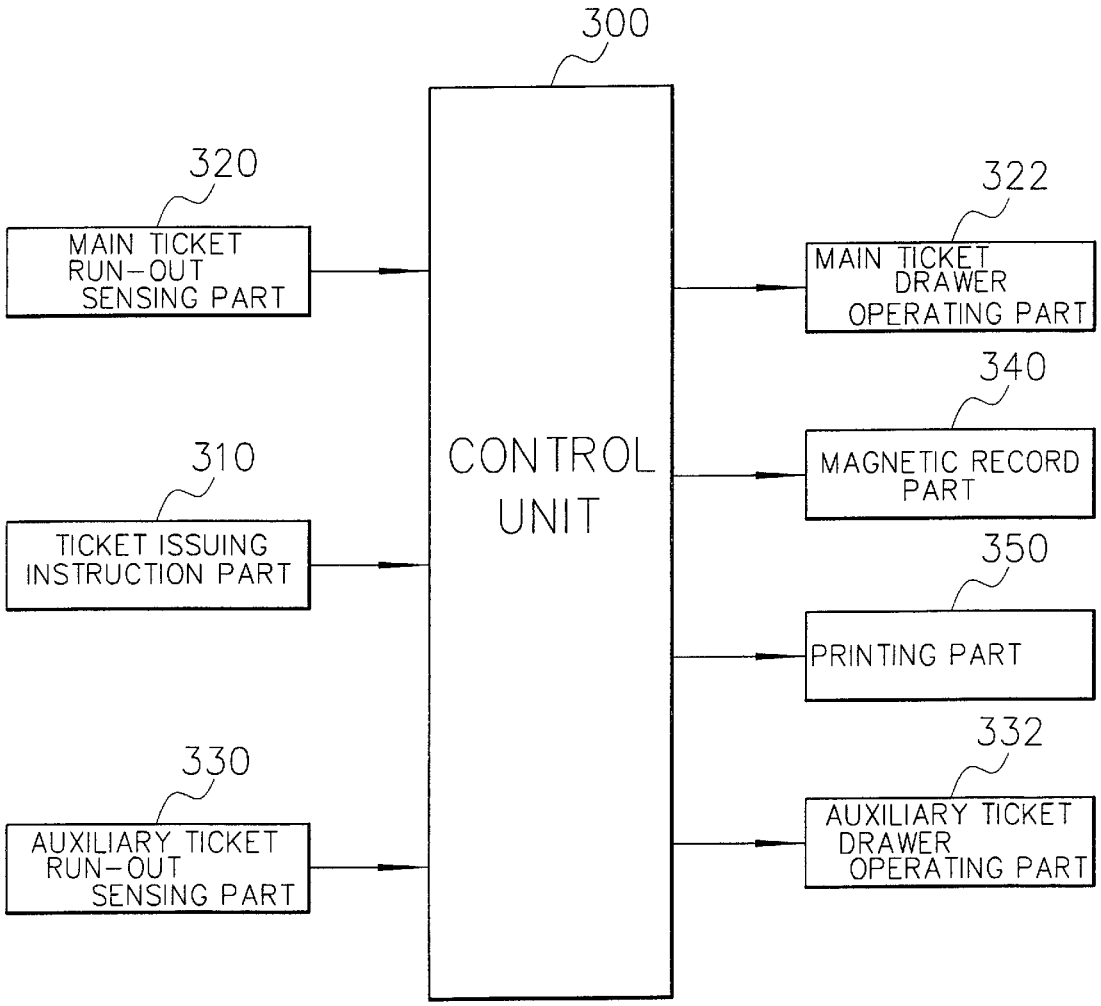
FIG. 5 is a block diagram representing electrical circuitry of an automatic toll-ticket issuing apparatus in accordance with the present invention.

As shown in FIG. 5, the present invention comprises: a control unit 300 for controlling the operation of the automatic toll-ticket issuing apparatus 200, and for performing various functions; a ticket issuing instruction part 310 for sensing the type of vehicle approaching the toll gate entrance and for generating a ticket issuing request signal; a main ticket run-out sensing part 320 and an auxiliary ticket run-out sensing part 330 for sensing exhaustion of tickets stacked in the main and auxiliary ticket cassettes 212 and 222, respectively; and main ticket drawer operation part 322 and auxiliary ticket drawer operation part 332 for drawing out tickets from the main and auxiliary ticket cassettes 212, 222, respectively, in response to a control signal from the control unit 300. The ticket issuing instruction part 310 includes electrical components in the form of a tread sensor and a vehicle high sensor.

The ticket issuing instruction part 310 senses the vehicle approaching the toll gate and generates a signal demanding the issuance of a ticket. As a result of the signal from the instruction part 310, the control unit 300 operates the main ticket drawer operation part 322 to withdraw a ticket from the main ticket cassette when no signal indicating running-out of tickets is received from the main ticket run-out sensing part 320. The information identifying the toll gate is written on the drawn ticket by the magnetic record part 340, and the information identifying the toll gate is printed on a predetermined area of the ticket passing through the magnetic record part 340.

When no signal indicating running-out of tickets is received from the auxiliary ticket run-out sensing part 330, but a signal indicating running-out of tickets is received from the main ticket run-out sensing part 320 and is transferred to the control unit 300, the control unit 300 switches the signal from the main ticket drawer operation part 322 to the auxiliary ticket drawer operation part 332. The ticket is withdrawn from the auxiliary ticket cassette 222 as a result of the signal from the auxiliary ticket drawer operation part 332. Similarly, when no signal indicating running-out of tickets is received from the main ticket running-out sensing part 320, but a signal indicating running-out of tickets is received from the auxiliary ticket run-out sensing part 330 and is transferred to the control unit 300, the control unit 300 switches the signal from the auxiliary ticket drawer operation part 332 to the main ticket drawer operation part 322. The ticket is withdrawn from the main ticket cassette 212 as a result of the signal from the main ticket drawer operation part 322. Therefore, issuance of tickets does not stop.

The operation of the apparatus in accordance with the invention is explained as below. The vehicle type identification sensor 112 senses the type of vehicle approaching the toll gate entrance, and generates a signal demanding issuance of a ticket. In the automatic toll-ticket issuing apparatus 200 which receives the signal, the ticket issuing instruction part 310 orders the control unit 300 to issue a ticket. The control unit 300 operates the main ticket drawing-out unit 214 to withdraw a ticket from the main ticket cassette 212. The ticket is fed to the ticket feed lane 230 by the upper ticket feeder 218. The information identifying the toll gate entrance is written on the ticket in the ticket feed lane 230 by the magnetic record part 340. The information is further printed by the printing part 350 on a predetermined area of the ticket passing the magnetic record part 340.

When the tickets stacked in the main ticket cassette 212 have run out, the main ticket run-out sensor 216 detects that condition and transfers the sensed signal to the control unit 300. The control unit 300 issues a transferred signal which order that the operation of withdrawing a ticket be moved from the main ticket cassette 212 to the auxiliary ticket cassette 222. The auxiliary ticket issuing unit 224 is operated to withdraw a ticket from the auxiliary ticket cassette 222. That is, the auxiliary ticket drawing-out unit 224 mounted adjacent to the auxiliary ticket container 220 withdraws a ticket stacked in the auxiliary ticket cassette 222 as approach of the vehicle is detected. The drawn-out ticket is fed to the ticket feed lane 230 by the lower ticket feeder 228.

The empty ticket cassette 212, in which the tickets have run out, is unloaded from the automatic toll-ticket issuing apparatus 200 and is filled with the new tickets. Otherwise, the spare cassette filled with the tickets is substituted for the empty ticket cassette 212. The empty ticket cassette 212 is refilled with new tickets and is utilized as an additional cassette to replace the loaded cassette when it runs out of tickets. Therefore, the spare cassette filled with new tickets is stored until tickets in the current cassette run out.

As indicated above, since the spare ticket cassette is loaded in the main ticket container 210 in which the tickets have run out, when the tickets of the auxiliary ticket container run out, the signal of the control unit 300 is sent to the main ticket container 210 to enable tickets to be continuously issued.

According to the present invention as described above, since the main and auxiliary ticket containers 210 and 220, respectively, are provided in the automatic toll-ticket issuing apparatus 200, tickets are continuously issued from the auxiliary ticket container 220 when the tickets stored in the main ticket container 210 have run out. Furthermore, since the extra ticket cassette outnumbers the number of the ticket containers 210 and 220, an empty cassette is rapidly replaced with a cassette full of tickets.

The invention as described above can be adapted to other ticket issuing machines, e.g., machines for issuing number slips utilized in the banking business.

It is to be understood that this invention is not in any way limited to the embodiments herein described and illustrated but may be otherwise variously embodied without departing from the spirit and scope of the invention.

What is claimed:

1. An automatic toll-ticket issuing apparatus which enables toll-tickets to be continuously issued, said apparatus comprising;

plural toll-ticket containers disposed in the automatic toll-ticket issuing apparatus;

plural ticket cassettes each loaded in a respective one of the toll-ticket containers for storing stacked toll-tickets therein;

ticket withdrawing means installed in close proximity to each of said toll-ticket containers for withdrawing the toll-tickets stored in the ticket cassettes;

sensing means installed in close proximity to each of said toll-ticket containers for identifying running out of the toll-tickets stored in the ticket cassettes and issuing a sensing signal; and control means responsive to the sensing signal for changing a ticket feeding route between a current ticket cassette and an issuing slot to a further tickets feeding route between an alternative ticket cassette and the issuing slot when the current ticket cassette runs out of toll-tickets stored therein, thereby preventing the issuance of the toll-tickets from stopping.

2. The apparatus of claim 1, wherein the toll-ticket containers comprise a main ticket container and auxiliary ticket containers.

3. The apparatus of claim 2, wherein the main ticket container and the auxiliary ticket containers are horizontally arranged one above the other.

4. The apparatus of claim 2, wherein said sensing means comprises a main ticket run-out sensing part and an auxiliary ticket run-out sensing part.

5. The apparatus of claim 1, wherein said sensing means comprises a main ticket run-out sensing part and an auxiliary ticket run-out sensing part.

6. The apparatus of claim 1, further comprising vehicle type identification means for identifying a type of vehicle approaching the automatic toll-ticket issuing apparatus.

7. The apparatus of claim 6, further comprising printing means for printing information on each of the toll-tickets issued by the apparatus, said information corresponding to the type of vehicle identified by said vehicle type identification means.

8. The apparatus of claim 6, wherein said vehicle type identification means comprises at least one of a vehicle with detector and a vehicle height detector.

9. The apparatus of claim 6, further comprising ticket issuing means for issuing tickets corresponding to the vehicle type identified by said vehicle type identification means.

10. The apparatus of claim 6, further comprising an additional issuing slot, said vehicle type identification means identifying relatively large vehicles and relatively small vehicles; and wherein, when said relatively large vehicles are identified, tickets are issued through said issuing slot, and, when said relatively small vehicles are identified, said tickets are issued through said additional issuing slot.

11. An automatic toll-ticket issuing apparatus which enables toll-tickets to be continuously issued, said apparatus comprising:

tickets storing means for storing tickets therein;

tickets withdrawing means disposed in proximity to said tickets storing means for withdrawing the tickets stored in said tickets storing means;

sensing means disposed in proximity to said tickets storing means for identifying running out of said tickets stored in said tickets storing means and issuing a sensing signal; and control means responsive to said sensing signal for changing a ticket feeding route between a first portion of said tickets storing means and an issuing slot to a further ticket feeding route between a second portion of said tickets storing means and said issuing slot when the first portion of said tickets storing runs out of tickets, thereby preventing the issuance of tickets from stopping.

12. The apparatus of claim 11, wherein said first portion of said tickets storing means comprises a main ticket container and said second portion of said tickets storing means comprises an auxiliary ticket container.

13. The apparatus of claim 12, wherein the main ticket container and the auxiliary ticket containers are horizontally arranged one above the other.

14. The apparatus of claim 12, wherein said sensing means comprises a main ticket run-out sensing part and an auxiliary ticket run-out sensing part.

15. The apparatus of claim 11, wherein said sensing means comprises a main ticket run-out sensing part and an auxiliary ticket run-out sensing part.

16. The apparatus of claim 11, further comprising vehicle type identification means for identifying a type of vehicle approaching the automatic toll-ticket issuing apparatus.

17. The apparatus of claim 16, further comprising printing means for printing information on each of the toll-tickets issued by the apparatus, said information corresponding to the type of vehicle identified by said vehicle type identification means.

18. The apparatus of claim 16, wherein said vehicle type identification means comprises at least one of a vehicle with detector and a vehicle height detector.

19. The apparatus of claim 16, further comprising ticket issuing means for issuing tickets corresponding to the vehicle type identified by said vehicle type identification means.

20. The apparatus of claim 16, further comprising an additional issuing slot, said vehicle type identification means identifying relatively large vehicles and relatively small vehicles; and wherein, when said relatively large vehicles are identified, tickets are issued through said issuing slot, and, when said relatively small vehicles are identified, said tickets are issued through said additional issuing slot.

* * * * *